US010650758B2

(12) United States Patent
Zha

(10) Patent No.: US 10,650,758 B2
(45) Date of Patent: May 12, 2020

(54) MULTI ZONE BACKLIGHT CONTROLLING METHOD AND DEVICE THEREOF

(71) Applicant: Wuhan China Star Optoelectronics Technology Co., Ltd., Wuhan, Hubei (CN)

(72) Inventor: Guowei Zha, Guangdong (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 79 days.

(21) Appl. No.: 16/030,472

(22) Filed: Jul. 9, 2018

(65) Prior Publication Data

US 2019/0156770 A1 May 23, 2019

Related U.S. Application Data

(63) Continuation of application No. PCT/CN2018/087673, filed on May 21, 2018.

(30) Foreign Application Priority Data

Nov. 21, 2017 (CN) ..... 2017 1 1168572

(51) Int. Cl.
*G09G 3/36* (2006.01)
*G09G 3/34* (2006.01)

(52) U.S. Cl.
CPC ..... *G09G 3/3607* (2013.01); *G09G 3/342* (2013.01); *G09G 2320/0233* (2013.01); *G09G 2320/103* (2013.01); *G09G 2360/16* (2013.01)

(58) Field of Classification Search
CPC ..... G09G 3/3607; G09G 3/342; G09G 2320/0233; G09G 2320/0271; G09G 2320/103; G09G 5/10
See application file for complete search history.

(56) References Cited

U.S. PATENT DOCUMENTS 8,766,904 B2 7/2014 Neal
2007/0002000 A1* 1/2007 Kwon ..... G09G 3/3426 345/102
2010/0079476 A1* 4/2010 Baba ..... G09G 3/3406 345/589

(Continued)

FOREIGN PATENT DOCUMENTS

CN 101211537 A 7/2008
CN 101414437 A 4/2009

(Continued)

*Primary Examiner* — William Boddie
*Assistant Examiner* — Jeffrey Parker
(74) *Attorney, Agent, or Firm* — Leong C. Lei

(57) ABSTRACT

Provided are a multi zone backlight controlling method and a device thereof. The method includes: obtaining original grayscale values of pixels of the image; obtain a backlight control coefficient correction factor according to the original grayscale value; obtaining a first backlight control coefficient and a second backlight control coefficient based on the backlight control coefficient correction factor and the original grayscale values, and adjusting backlight brightness according to the first backlight control coefficient and the second backlight control coefficient, thereby reducing difference between the display image and the real image.

6 Claims, 6 Drawing Sheets

(56) References Cited

U.S. PATENT DOCUMENTS

| | | | | |
|---|---|---|---|---|
| 2016/0019846 | A1* | 1/2016 | Kim | G09G 3/3406<br>345/690 |
| 2018/0090082 | A1* | 3/2018 | Zhang | G09G 3/3607 |

FOREIGN PATENT DOCUMENTS

| | | | |
|---|---|---|---|
| CN | 101707051 | A | 5/2010 |
| CN | 101937652 | A | 1/2011 |
| CN | 102102824 | A | 6/2011 |
| CN | 102243855 | B | 12/2012 |
| CN | 101673521 | B | 1/2014 |
| CN | 105185327 | A | 12/2015 |
| CN | 107204174 | A | 9/2017 |
| CN | 107680542 | A | 2/2018 |

* cited by examiner

MULTI ZONE BACKLIGHT CONTROLLING METHOD AND DEVICE THEREOF

CROSS-REFERENCE TO RELATED APPLICATION

This application is a continuing application of PCT Patent Application No. PCT/CN2018/087673 entitled "Multi zone backlight controlling method and device thereof", filed on May 21, 2018, which claims priority to Chinese Patent Application No. 201711168572.0, filed on Nov. 21, 2017, both of which are hereby incorporated in its entireties by reference.

FIELD OF THE INVENTION

The present invention relates to a display technology field, and more particularly to a multi zone backlight controlling method and a device thereof.

BACKGROUND OF THE INVENTION

The core of the display technology is to reproduce the visual perception of the human eye to the natural world. Currently, the mainstream display technologies include the Liquid Crystal Display (LCD) technology and the Organic Light-Emitting Diode (OLED) technology, among which the LCD technology possesses obvious advantages in terms of cost and reliability.

Currently, the LCD technology in the market mainly utilizes multi zone backlight technology to further improve the performance thereof. However, when the conventional multi zone backlight technology displays an image and the backlight adjustments are performed on different partitions, each partition has mutually independent backlight control coefficients, and only independent backlight control coefficients are used to adjust the backlight brightness, and the brightness is different between different partitions. There is an inconsistency in brightness adjustment, and then a larger difference of backlight brightness between partitions for local areas may easily occur, thus resulting in a large distortion in the local areas of the image to cause a larger difference between the displayed image and the real image.

SUMMARY OF THE INVENTION

The embodiment of the present invention provides a multi zone backlight controlling method and a device thereof, which can reduce the difference between display image and real image to certain extent.

First, the embodiment of the present invention provides a multi zone backlight controlling method, comprising:

obtaining original grayscale values of pixels of an image displayed in a display area, wherein the display area includes a first partition and a second partition, the image includes a first image block and a second image block, the first image block is displayed in the first partition, and the second image block is displayed in the second partition, the original grayscale value includes a first original grayscale value of each pixel point in the first image block and a second original grayscale value of each pixel point in the second image block;

obtaining a backlight control coefficient correction factor of the image according to the original grayscale value;

obtaining a first backlight control coefficient of the first partition based on the backlight control coefficient correction factor and the first original grayscale value, and adjusting a backlight brightness of the first partition according to the first backlight control coefficient; and obtaining a second backlight control coefficient of the second partition based on the backlight control coefficient correction factor and the second original grayscale value, and adjusting a backlight brightness of the second partition according to the second backlight control coefficient.

Second, the embodiment of the present invention provides a multi zone backlight controlling device, comprising:

an obtaining unit, obtaining original grayscale values of pixels of an image displayed in a display area, wherein the display area includes a first partition and a second partition, the image includes a first image block and a second image block, the first image block is displayed in the first partition, and the second image block is displayed in the second partition, the original grayscale value includes a first original grayscale value of each pixel point in the first image block and a second original grayscale value of each pixel point in the second image block;

a calculating unit, obtaining a backlight control coefficient correction factor of the image according to the original grayscale value;

a first processing unit, obtaining a first backlight control coefficient of the first partition based on the backlight control coefficient correction factor and the first original grayscale value, and adjusting a backlight brightness of the first partition according to the first backlight control coefficient; and a second processing unit, obtaining a second backlight control coefficient of the second partition based on the backlight control coefficient correction factor and the second original grayscale value, and adjusting a backlight brightness of the second partition according to the second backlight control coefficient.

Third, the embodiment of the present invention provides a computer-readable storage medium, wherein the computer-readable storage medium is used for storing a computer program, and wherein the computer program enables the computer to implement some or all of the methods described in the embodiment of the present invention provided first.

Third, the embodiment of the present invention provides a computer program product, wherein the computer program product includes a non-transitory computer-readable storage medium storing a computer program, and the computer program enables the computer to implement some or all of the methods described in the embodiment of the present invention provided first.

With implementing the embodiments of the present invention, the benefits are:

It can be seen that, according to the embodiment of the present invention, the original grayscale value of the pixel of the image is obtained, and the backlight coefficient correction factor is obtained according to the original grayscale value. Because the original grayscale values are the grayscale values of all the pixels in the image, the backlight factor correction factor is global, and the backlight control coefficients of different partitions can be corrected from the perspective of the backlight brightness of the entire image. Thus, the backlight control coefficients of different partitions are introduced into the aforementioned backlight control coefficient correction factor, so that mutually independent backlight control coefficients are corrected by a unified global variable, and the backlight brightnesses in different partitions are adjusted to make a unified correction, so that when the brightness of the backlight is adjusted among different partitions, the reference is made to a uniform reference amount. Therefore, the adjustment of the backlight brightnesses of the different partitions in the different partitions is coordinated, which can alleviate the difference in backlight brightnesses generated among the partitions in the local area when the backlight brightness is adjusted under circumstance that the backlight control coefficients between different partitions are independent from each other. Thus, the situation in which the local area of the image is greatly distorted is improved, and the difference between the display image and the real image can be reduced to certain extent.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

The terminologies "first" and "second" in the specification, claims and aforesaid figures of the present invention are used for distinguishing different objects but not for describing the specific sequence. Furthermore, the terms "including" and "having" and their any deformations are intended to cover non-exclusive inclusion. For example, a process, a method, a system, a product or a device comprising a series of steps or units which is not limited to the steps or units already listed, but optionally further comprises steps or units which are not listed, or optionally further comprises other steps or units which are inherent in these the process, the method, the product or the device.

Reference in this invention to "embodiment" means that a particular feature, structure, or characteristic described in connection with the embodiment is included in at least one embodiment of the present invention. Appearances of the phrase "embodiment" in various places in the specification do not necessarily refer to the same embodiment, nor are separate or alternative embodiments mutually exclusive of other embodiments. Those skilled in the art implicitly and explicitly understand that the embodiments described in the present invention may be combined with other embodiments.

Figure 1A:
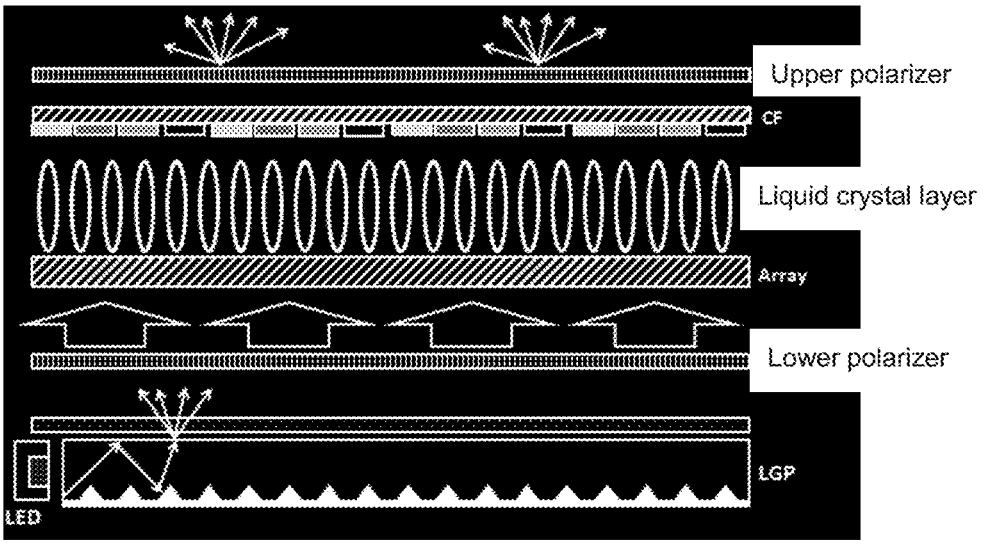
FIG. 1A is an application scenario diagram of a multi zone backlight controlling method according to the embodiment of the present invention.

In order to better understand the technical solution of the present invention, the following briefly introduces an application scenario of a multi zone backlight controlling method according to the embodiment of the present invention. Please refer to FIG. 1A. FIG. 1A is the application scenario diagram, including a light emitting diode (LED), a light guide plate (LGP), a lower polarizer, an array substrate, a liquid crystal layer, a color filter (CF) and an upper polarizer. The LED emits light, which is refracted by the light guide plate and refracted into the lower polarizer. The light enters the array substrate after passing through the lower polarizer, and enters the liquid crystal layer after being adjusted by the array substrate, and then passes through the liquid crystal layer and enters the color filter, and the light emitted by the LED Is filtered into lights of different colors, and finally the light is spread through the upper polarizer. Based on the above application scenario, the multi zone backlight controlling method provided by the present invention performs partitioned backlight on the entire display, and introduces a backlight control coefficient correction factor into the backlight control coefficients of the partitions to enable the backlight control coefficients of different partitions to be uniformly corrected by the backlight control correction factor. Therefore, it is possible to alleviate the backlight difference among the different partitions in a local area caused by the use of the mutually independent backlight control coefficients for the different partitions to adjust the backlight, and the local area of the image is greatly distorted, resulting in a larger difference between the display image and the real image. Certainly, the application scenario of the embodiment of the present invention includes but is not limited to the above application scenario.

Figure 1B:
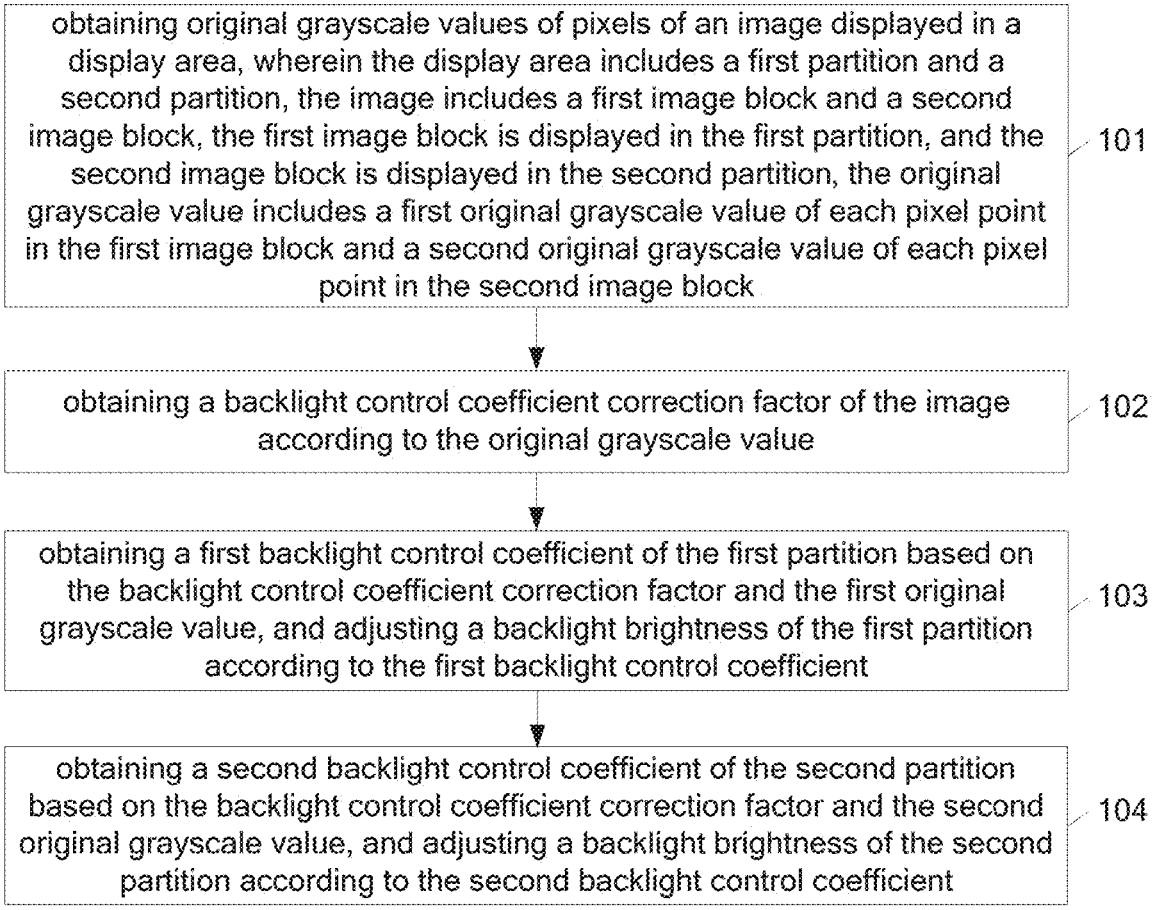
FIG. 1B is a flowchart of a multi zone backlight controlling method according to the embodiment of the present invention.

Based on the application scenario described in FIG. 1A above, FIG. 1B is a flowchart of a multi zone backlight controlling method according to the embodiment of the present invention. As shown in FIG. 1B, the multi zone backlight controlling method according to the embodiment of the present invention comprises steps of:

101, obtaining original grayscale values of pixels of an image displayed in a display area, wherein the display area includes a first partition and a second partition, the image includes a first image block and a second image block, the first image block is displayed in the first partition, and the second image block is displayed in the second partition, the original grayscale value includes a first original grayscale value of each pixel point in the first image block and a second original grayscale value of each pixel point in the second image block.

Optionally, the display area includes a first partition and a second partition, wherein the first partition or the second partition is not only a single partition, but the first partition and the second partition may also include a plurality of sub partitions, and the first partition and the second partition are merely used to distinguish different partitions.

Optionally, the grayscales of pixels are obtained. The grayscale are (H, W, T), wherein H is the vertical resolution of the display area, W is the horizontal resolution of the display area, and T can include R, G, and B. R denotes a red pixel value, G denotes a green pixel value and B denotes a blue pixel value. T may also include R, G B, and W, wherein R denotes a red pixel value, G denotes a green pixel value, B denotes a blue pixel value and W denotes a white pixel value. T may also include R, G B, and Y, wherein R denotes a red pixel value, G denotes a green pixel value, B denotes a blue pixel value and Y denotes a yellow pixel value. T can also include other pixel values.

Optionally, according to the pixel feature value of respective pixel points obtained by T, the pixel feature value is the maximum value of respective pixel values in T. For instance, T includes R, G and B, and as the R pixel value is the maximum value among the three, and then R is as the pixel feature value.

Optionally, original grayscale values are obtained. The original grayscale values are the pixel feature values of respective pixel points.

102, obtaining a backlight control coefficient correction factor of the image according to the original grayscale value.

Optionally, an average operation is performed on the original grayscale values of pixels of the image to obtain the target reference grayscale value of the image, and then a backlight control coefficient correction factor is obtained based on the original grayscale value.

103, obtaining a first backlight control coefficient of the first partition based on the backlight control coefficient correction factor and the first original grayscale value, and adjusting a backlight brightness of the first partition according to the first backlight control coefficient.

Optionally, comparing the first original grayscale value with a preset grayscale threshold to obtain a target grayscale value greater than the preset grayscale threshold in the first original grayscale value;

optionally, the preset grayscale threshold may be set according to the backlight brightness of each partition in the current display area. Specifically, for instance, firstly, the brightness of each partition in the display area is analyzed, and a range of the maximum possible grayscale values of the current grayscale is obtained, and a grayscale value is selected as the preset gray threshold in the range of the value. For instance, it is also possible to use 90 percent of the inherent maximum grayscale value of the display area as a preset grayscale threshold. The aforesaid inherent maximum grayscale value can be understood as taking 8 bit grayscale as an example, and it has 256 grayscales. Then, the inherent maximum gray value is 255.

Optionally, obtaining a weighted average value of the target grayscale values, and obtaining a first reference backlight control coefficient of the first image block according to the weighted average value.

Optionally, the weighted average can be obtained by the weighted average algorithm. Specifically, for instance, taking the inherent maximum gray value 255 as an example, the preset grayscale threshold is 229.5. Since the grayscale value is an integer, thus, 230 is a preset grayscale value, and as the first original grayscale values greater than the grayscale value 230 are 231, 232, 233, 234, 235, 235, 240, 250, 255, and 236, and the weighted average value of the above grayscale values is 238.1, which is rounded to 238.

Optionally, obtaining the first backlight control coefficient based on the first reference backlight control coefficient and the backlight control coefficient correction factor.

104, obtaining a second backlight control coefficient of the second partition based on the backlight control coefficient correction factor and the second original grayscale value, and adjusting a backlight brightness of the second partition according to the second backlight control coefficient.

With the aforesaid embodiment, the original grayscale value of the pixel of the image is obtained, and the backlight coefficient correction factor is obtained according to the original grayscale value. Because the original grayscale values are the grayscale values of all the pixels in the image, the backlight factor correction factor is global, and the backlight control coefficients of different partitions can be corrected from the perspective of the backlight brightness of the entire image. Thus, the backlight control coefficients of different partitions are introduced into the aforementioned backlight control coefficient correction factor, so that mutually independent backlight control coefficients are corrected by a unified global variable, and the backlight brightnesses in different partitions are adjusted to make a unified correction, so that when the brightness of the backlight is adjusted among different partitions, the reference is made to a uniform reference amount. Therefore, the adjustment of the backlight brightnesses of the different partitions in the different partitions is coordinated, which can alleviate the difference in backlight brightnesses generated among the partitions in the local area when the backlight brightness is adjusted under circumstance that the backlight control coefficients between different partitions are independent from each other. Thus, the situation in which the local area of the image is seriously distorted is improved, and the difference between the display image and the real image can be reduced to certain extent.

Figure 2A:
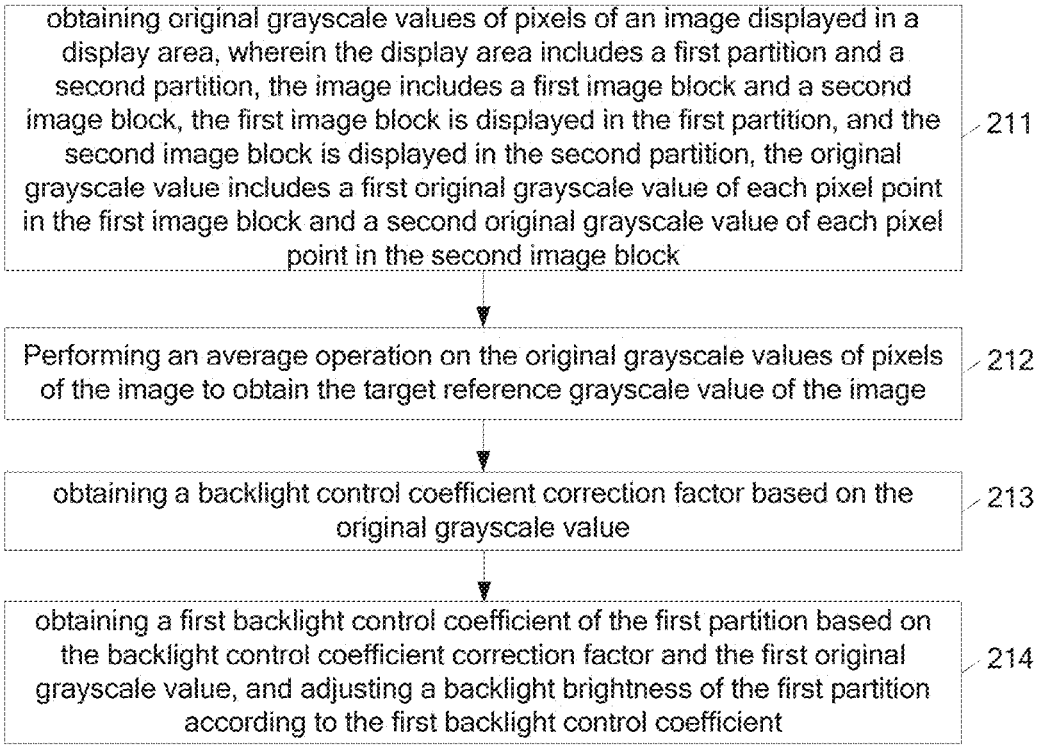
FIG. 2A is an application scenario diagram of another multi zone backlight controlling method according to the embodiment of the present invention.

Based on the application scenario described in FIG. 1A above, FIG. 2A is a flowchart of another multi zone backlight controlling method according to the embodiment of the present invention. As shown in FIG. 2A, the multi zone backlight controlling method according to the embodiment of the present invention comprises steps of:

211, obtaining original grayscale values of pixels of an image displayed in a display area, wherein the display area includes a first partition and a second partition, the image includes a first image block and a second image block, the first image block is displayed in the first partition, and the second image block is displayed in the second partition, the original grayscale value includes a first original grayscale value of each pixel point in the first image block and a second original grayscale value of each pixel point in the second image block.

212, performing an average operation on the original grayscale values of pixels of the image to obtain the target reference grayscale value of the image.

Optionally, obtaining the target reference grayscale value can also use the following method:

performing an average operation on the second original grayscale value to obtain a second reference grayscale value of the second image block, and performing an average operation on the first reference grayscale value and the second reference grayscale value to obtain a target reference grayscale value of the image, wherein with this method, the average grayscale value of the first partition and the second partition can be obtained. Then, the first original backlight control coefficient can be obtained from the average grayscale value of the first partition according to the average grayscale value of the first partition and the second original backlight control coefficient can be obtained from the average grayscale value of the second partition. The aforesaid first original backlight control coefficient and the second original backlight control coefficient are the backlight control coefficients in the prior art. Therefore, it can further show that the first backlight control coefficient and the second backlight control coefficient in the embodiment of the present invention are distinguished from the mutually independent figure of different control coefficients in the prior art.

Optionally, obtaining the target reference grayscale value can also use the following method:

performing an average operation on the first original grayscale value and the second original grayscale value to obtain a target reference grayscale value of the target image.

213, obtaining a backlight control coefficient correction factor based on the original grayscale value.

Optionally, a function mapping relationship between the target reference grayscale value and the backlight control coefficient correction factor is:

$$f(x) = \begin{cases} 0, x = 0 \\ 1, x \in [0.05a, 0.3a] \\ (0.5, 1), x = a \\ (0, 0.5], x \in (0, 0.05a) \cup (0.3a, a) \end{cases},$$

wherein f(x) is the backlight control coefficient correction factor, and x is the target reference grayscale value, and a is a maximum grayscale value of the pixel point of the image in the display area, and the maximum grayscale value is an inherent maximum gray level value of the image.

Optionally, the backlight control coefficient correction factor is obtained after transforming the target reference grayscale value with the function mapping relationship. For instance, as the target reference grayscale value is 0.4a, the value of the backlight control coefficient correction factor is in a range of 0 to 0.5 including 0.5, which means that the backlight of the display area in certain areas is brighter and the backlight brightness needs to be greatly reduced.

214, obtaining a first backlight control coefficient of the first partition based on the backlight control coefficient correction factor and the first original grayscale value, and adjusting a backlight brightness of the first partition according to the first backlight control coefficient.

Optionally, comparing the first original grayscale value with a preset grayscale threshold to obtain a target grayscale value greater than the preset grayscale threshold in the first original grayscale value;

optionally, determining whether a number of the target grayscale values is greater than a preset number, and as the number of the target grayscale values is greater than the preset number, the target grayscale value is the first reference backlight control coefficient of the first image block, wherein the preset number can be specifically set according to the contrast of the color of the image. For instance, as the contrast of the image is higher, the preset number is set to a value between 5% and 10% of the inherent maximum grayscale value of the display area, and as the contrast of the image is lower, the preset number is set to a value between 10% and 15% of the inherent maximum grayscale value of the display area.

Optionally, obtaining the first backlight control coefficient based on the first reference backlight control coefficient and the backlight control coefficient correction factor.

Optionally, the first reference backlight control coefficient and the backlight control coefficient correction factor may be multiplied to obtain a first backlight control coefficient.

Optionally, the first reference backlight control coefficient may be multiplied with a matrix and then multiplied with the backlight control coefficient correction factor to obtain the first backlight control coefficient, wherein an order of the matrix is the same as that of the matrix formed by the coordinates of the first partition. With the foregoing method, the backlight control coefficient can be distributed to each pixel point, so that the brightness of the backlight of each pixel can be adjusted to make the backlight adjustment more accurate.

Optionally, the backlight brightness of the display area is detected. As it is detected that the backlight brightness of the display area is greater than the preset brightness value, the backlight brightness of the first partition is reduced according to the first backlight control coefficient, wherein the preset brightness value may be a value between 70% and 90% of the inherent maximum grayscale value as a preset brightness value for illustration. Specifically, taking the maximum grayscale value as 255 as an illustration, the preset brightness value may be set as 80% of the inherent maximum gray level value, i.e. 204. After reducing the backlight brightness, the energy consumption of the display area LEDs can be reduced, so that the energy consumption of the entire display area can be reduced. Meanwhile, the reduction of the backlight brightness can also reduce the stimulation of the human eye in the display area, thereby further reducing the occurrence of glare to certain context.

As it is detected that the backlight brightness of the display area is less than the preset brightness value, the backlight brightness of the first partition is increased according to the first backlight control coefficient, wherein the preset brightness value may be a value between 20% and 40% of the inherent maximum grayscale value as a preset brightness value for illustration. Specifically, taking the maximum grayscale value as 255 as an illustration, the preset brightness value may be set as 20% of the inherent maximum gray level value, i.e. 51. After the brightness of the backlight of the first partition is increased, the brightness of the image of the first partition is reduced to certain context, which is favorable for the comfort of viewing the image by the human eye.

For the specific description of the foregoing Step 211 to Step 214, reference may be made to the corresponding steps of the resource configuration method described in FIG. 1B, and details are not described herein again.

Figure 2B:
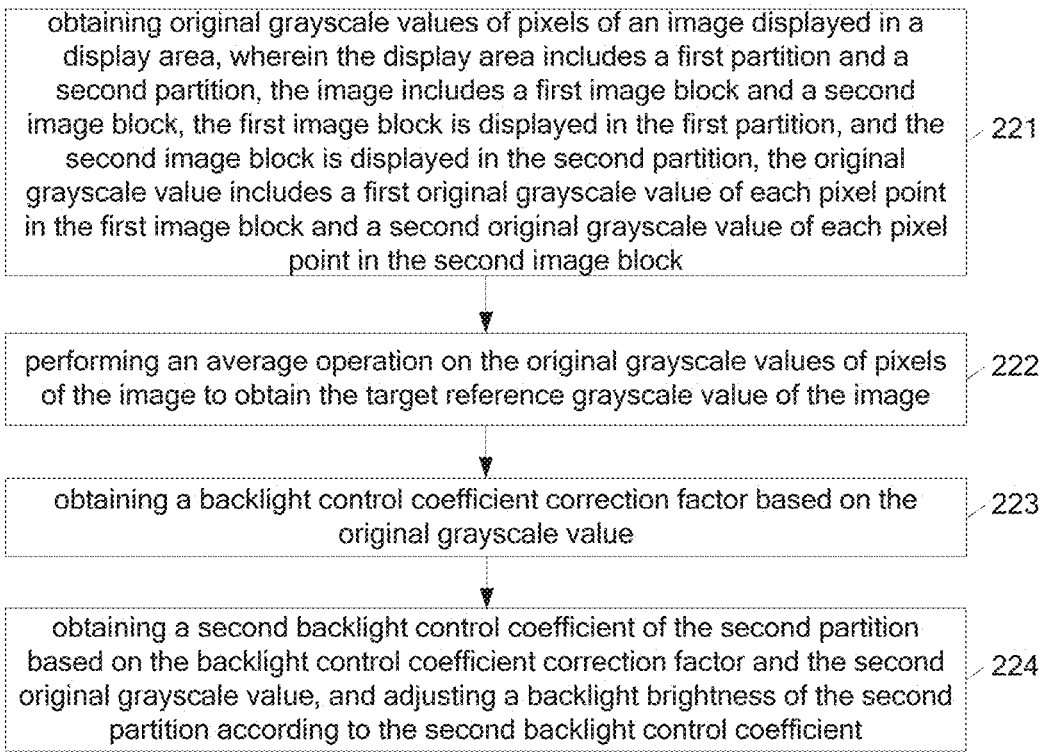
FIG. 2B is an application scenario diagram of one another multi zone backlight controlling method according to the embodiment of the present invention.

Based on the application scenario described in FIG. 1A above, FIG. 2B is a flowchart of another multi zone backlight controlling method according to the embodiment of the present invention. As shown in FIG. 2B, the multi zone backlight controlling method according to the embodiment of the present invention comprises steps of:

221, obtaining original grayscale values of pixels of an image displayed in a display area, wherein the display area includes a first partition and a second partition, the image includes a first image block and a second image block, the first image block is displayed in the first partition, and the second image block is displayed in the second partition, the original grayscale value includes a first original grayscale value of each pixel point in the first image block and a second original grayscale value of each pixel point in the second image block.

222, performing an average operation on the original grayscale values of pixels of the image to obtain the target reference grayscale value of the image.

223, obtaining a backlight control coefficient correction factor based on the original grayscale value.

224, obtaining a second backlight control coefficient of the second partition based on the backlight control coefficient correction factor and the second original grayscale value, and adjusting a backlight brightness of the second partition according to the second backlight control coefficient.

Optionally, comparing the second original grayscale value with a preset grayscale threshold to obtain a target grayscale value greater than the preset grayscale threshold in the second original grayscale value;

optionally, determining whether a number of the target grayscale values is greater than a preset number, and as the number of the target grayscale values is greater than the preset number, the target grayscale value is the second reference backlight control coefficient of the second image block, wherein the preset number can be specifically set according to the contrast of the color of the image. For instance, as the contrast of the image is higher, the preset number is set to a value between 5% and 10% of the inherent maximum grayscale value of the display area, and as the contrast of the image is lower, the preset number is set to a value between 10% and 15% of the inherent maximum grayscale value of the display area.

Optionally, obtaining the second backlight control coefficient based on the second reference backlight control coefficient and the backlight control coefficient correction factor.

Optionally, the second reference backlight control coefficient and the backlight control coefficient correction factor may be multiplied to obtain a second backlight control coefficient.

Optionally, the second reference backlight control coefficient may be multiplied with a matrix and then multiplied with the backlight control coefficient correction factor to obtain the second backlight control coefficient, wherein an order of the matrix is the same as that of the matrix formed by the coordinates of the second partition. With the foregoing method, the backlight control coefficient can be distributed to each pixel point, so that the brightness of the backlight of each pixel can be adjusted to make the backlight adjustment more accurate.

Optionally, the backlight brightness of the display area is detected. As it is detected that the backlight brightness of the display area is greater than the preset brightness value, the backlight brightness of the second partition is reduced according to the second backlight control coefficient, wherein the preset brightness value may be a value between 70% and 90% of the inherent maximum grayscale value as a preset brightness value for illustration. Specifically, taking the maximum grayscale value as 255 as an illustration, the preset brightness value may be set as 80% of the inherent maximum gray level value, i.e. 204. After reducing the backlight brightness, the energy consumption of the display area LEDs can be reduced, so that the energy consumption of the entire display area can be reduced. Meanwhile, the reduction of the backlight brightness can also reduce the stimulation of the human eye in the display area, thereby further reducing the occurrence of glare to certain context.

As it is detected that the backlight brightness of the display area is less than the preset brightness value, the backlight brightness of the second partition is increased according to the second backlight control coefficient, wherein the preset brightness value may be a value between 20% and 40% of the inherent maximum grayscale value as a preset brightness value for illustration. Specifically, taking the maximum grayscale value as 255 as an illustration, the preset brightness value may be set as 20% of the inherent maximum gray level value, i.e. 51. After the brightness of the backlight of the second partition is increased, the brightness of the image of the second partition is reduced to certain context, which is favorable for the comfort of viewing the image by the human eye.

For the specific description of the foregoing Step 221 to Step 223, reference may be made to the corresponding steps of the resource configuration method described in FIG. 2A, and details are not described herein again.

Figure 3A:
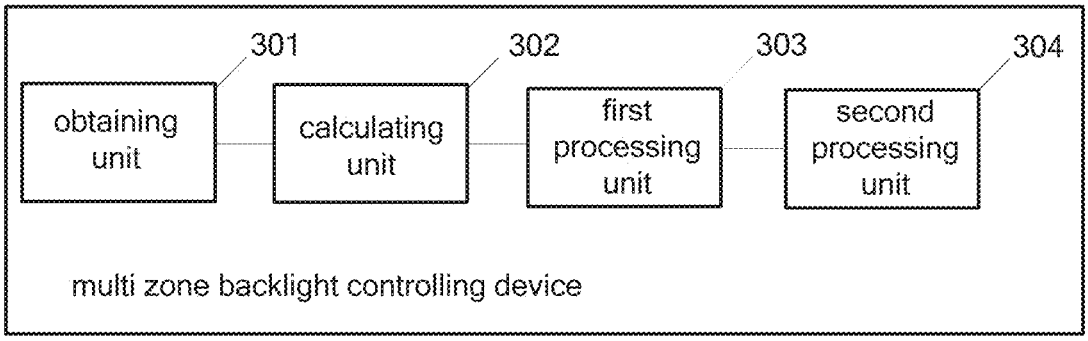
FIG. 3A is a structure diagram of a multi zone backlight controlling device according to the embodiment of the present invention.

Please refer to FIG. 3A. As shown in FIG. 3A, FIG. 3A is a structure diagram of a multi zone backlight controlling device according to the embodiment of the present invention. The multi zone backlight controlling device described in this embodiment comprises: an obtaining unit 301, a calculating unit 302, a first processing unit 303 and a second processing unit 304 as following:

an obtaining unit 301, obtaining original grayscale values of pixels of an image displayed in a display area, wherein the display area includes a first partition and a second partition, the image includes a first image block and a second image block, the first image block is displayed in the first partition, and the second image block is displayed in the second partition, the original grayscale value includes a first original grayscale value of each pixel point in the first image block and a second original grayscale value of each pixel point in the second image block;

a calculating unit 302, obtaining a backlight control coefficient correction factor of the image according to the original grayscale value;

a first processing unit 303, obtaining a first backlight control coefficient of the first partition based on the backlight control coefficient correction factor and the first original grayscale value, and adjusting a backlight brightness of the first partition according to the first backlight control coefficient; and a second processing unit 304, obtaining a second backlight control coefficient of the second partition based on the backlight control coefficient correction factor and the second original grayscale value, and adjusting a backlight brightness of the second partition according to the second backlight control coefficient.

In the aforesaid embodiment, the original grayscale value of the pixel of the image is obtained, and the backlight coefficient correction factor is obtained according to the original grayscale value. Because the original grayscale values are the grayscale values of all the pixels in the image, the backlight factor correction factor is global, and the backlight control coefficients of different partitions can be corrected from the perspective of the backlight brightness of the entire image. Thus, the backlight control coefficients of different partitions are introduced into the aforementioned backlight control coefficient correction factor, so that mutually independent backlight control coefficients are corrected by a unified global variable, and the backlight brightnesses in different partitions are adjusted to make a unified correction, so that when the brightness of the backlight is adjusted among different partitions, the reference is made to a uniform reference amount. Therefore, the adjustment of the backlight brightnesses of the different partitions in the different partitions is coordinated, which can alleviate the difference in backlight brightnesses generated among the partitions in the local area when the backlight brightness is adjusted under circumstance that the backlight control coefficients between different partitions are independent from each other. Thus, the situation in which the local area of the image is seriously distorted is improved, and the difference between the display image and the real image can be reduced to certain extent.

Figure 3B:
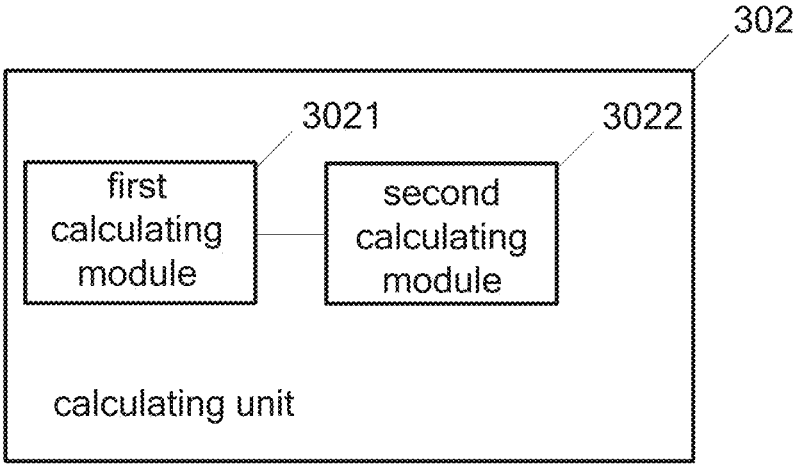
FIG. 3B is a possible structural diagram of a calculating unit 302 described in FIG. 3A according to the embodiment of the present invention.

Optionally, as shown in FIG. 3B, FIG. 3B is a possible structural diagram of a calculating unit 302, comprising: a first calculating module 3021 and a second calculating module 3022 as following:

a first calculating module 3021, performing an average operation on the first original grayscale values to obtain a first reference grayscale value of the first image block, and performing an average operation on the second original grayscale values to obtain a second reference grayscale value of the second image block, and performing an average operation on the first reference grayscale value and the second reference grayscale value to obtain a target reference grayscale value of the image, and obtaining the backlight control coefficient correction factor based on the target reference grayscale value;

a second calculating module 3022, performing an average operation on the original grayscale values of pixels of the image to obtain the target reference grayscale value of the image, and obtaining the backlight control coefficient correction factor based on the target reference grayscale value.

Figure 3C:
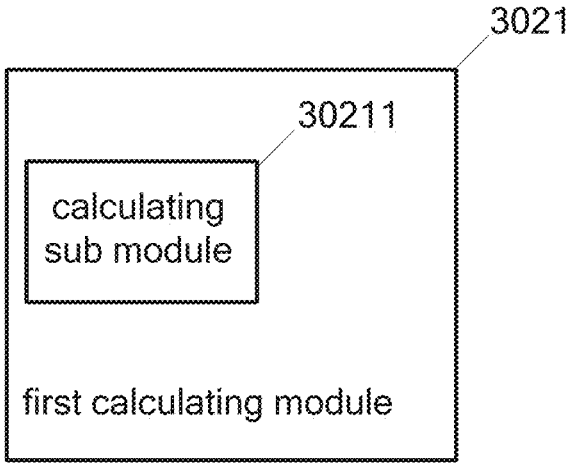
FIG. 3C is a possible structural diagram of a first calculating module 3021 described in FIG. 3B according to the embodiment of the present invention.

Optionally, as shown in FIG. 3C, FIG. 3C is a possible structural diagram of a first calculating module 3021, comprising: a calculating sub module 30211, as following:

a function mapping relationship between the target reference grayscale value and the backlight control coefficient correction factor $$f(x) = \begin{cases} 0, x = 0 \\ 1, x \in [0.05a, 0.3a] \\ (0.5, 1), x = a \\ (0, 0.5], x \in (0, 0.05a) \cup (0.3a, a) \end{cases},$$

wherein f(x) is the backlight control coefficient correction factor, and x is the target reference grayscale value, and a is a maximum grayscale value of the pixel point of the image in the display area;

a calculating sub module 30211, obtaining the backlight control coefficient correction factor after transforming the target reference grayscale value with the function mapping relationship.

Figure 3D:
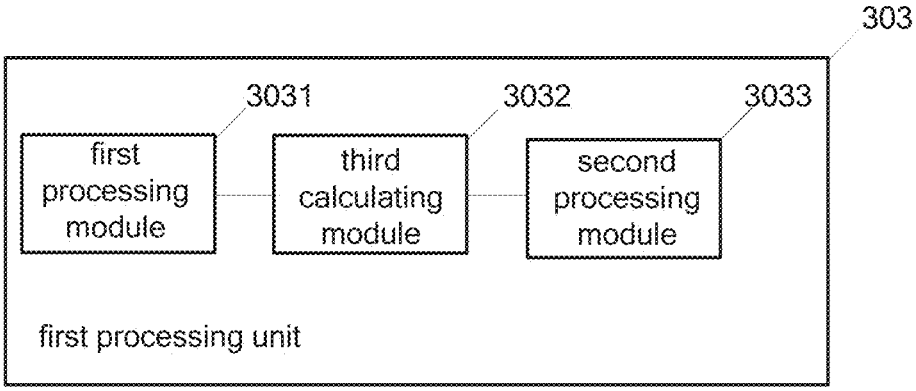
FIG. 3D is a possible structural diagram of a first processing unit 303 described in FIG. 3A according to the embodiment of the present invention.

Optionally, as shown in FIG. 3D, FIG. 3D is a possible structural diagram of a first processing unit 303, comprising a first processing module 3031, a third calculating module 3032 and a second processing module 3033 as following:

a first processing module 3031, comparing the first original grayscale value with a preset grayscale threshold to obtain a target grayscale value greater than the preset grayscale threshold in the first original grayscale value;

a third calculating module 3032, obtaining a weighted average value of the target grayscale values, and obtaining a first reference backlight control coefficient of the first image block according to the weighted average value; and a second processing module 3033, obtaining the first backlight control coefficient based on the first reference backlight control coefficient and the backlight control coefficient correction factor.

Figure 3E:
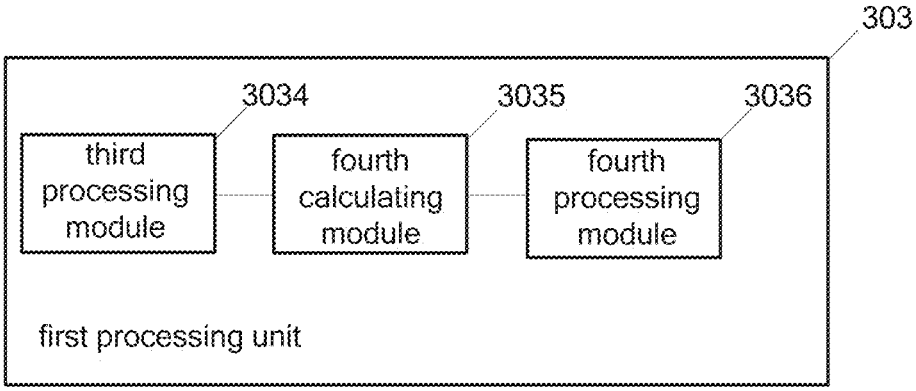
FIG. 3E is a possible structural diagram of another first processing unit 303 described in FIG. 3A according to the embodiment of the present invention.

Optionally, as shown in FIG. 3E, FIG. 3E is another possible structural diagram of a first processing unit 303, comprising: a third processing module 3034, a fourth calculating module 3035 and a fourth processing module 3036 as following:

a third processing module 3034, comparing the first original grayscale value with a preset grayscale threshold to obtain a target grayscale value greater than the preset grayscale threshold in the first original grayscale value;

a fourth calculating module 3035, determining whether a number of the target grayscale values is greater than a preset number, and as the number of the target grayscale values is greater than the preset number, the target grayscale value is the first reference backlight control coefficient of the first image block; and a fourth processing module 3036, obtaining the first backlight control coefficient based on the first reference backlight control coefficient and the backlight control coefficient correction factor.

The embodiment of the present invention further provides a computer storage medium, wherein the computer storage medium stores a computer program for electronic data exchange, and the computer program causes the computer to execute any of the multi zone backlight controlling methods as described in the above method embodiments, or to execute a part or all of the steps of the multi zone backlight controlling methods as described in the above method embodiments.

The embodiment of the present invention further provides a computer program product, wherein the computer program product includes a non-transitory computer-readable storage medium storing a computer program to execute any of the multi zone backlight controlling methods as described in the above method embodiments, or to execute a part or all of the steps of the multi zone backlight controlling methods as described in the above method embodiments.

It should be noted that, for each of the aforementioned embodiments of the method, for simplifying description, it is expressed as a combination of a series of actions. Nevertheless, the skilled person in this art should understand that the present invention is not limited to the described operation sequence because some steps can be employed in other order sequentially or simultaneously according to the present invention. Secondly, those skilled persons in this art should understand that the embodiments described in the specification are all the preferred embodiments, and the involved operations and modules of the present invention should not be not essential.

In the foregoing embodiments, the description of the various embodiments have respective different emphases, and a part in some embodiment, which is not described in detail can be referred to the related description of other embodiments.

In several embodiments provided in this application, it should be understood that the disclosed device may be implemented in other ways. As an illustration, the embodiment of the device described above is merely illustrative. For example, the division of the unit is only a logical function division and there are additional ways of actual implement, such as, multiple units or components may be combined or can be integrated into another system. Or, some feature can be ignored or not executed. In addition, the coupling, the direct coupling or the communication connection shown or discussed may be either an indirect coupling or a communication connection through some interfaces, devices or units, or may be electrically or otherwise connected.

The units described as the separation means may or may not be physically separated. The components shown as units may or may not be physical units, i.e., may be located in one place or may be distributed over a plurality of network units.

The part or all of the units can be selected according to the actual demands to achieve the object of the present embodiment.

The respective function units in the respective embodiments of the present application can be integrated in one process unit, or the individual units are physically present, or two or more units are integrated in one unit. The integrated units can be implemented in the form of hardware or in the form of a program module.

The integrated unit may be stored in a computer readable memory if implemented in the form of a software program module and sold or used as a stand-alone product. The computer software product is stored in a memory and includes instructions for causing a computer device (which may be a personal computer, a server or a network device, etc.) to perform all or part of the steps of the methods described in the various embodiments of the present invention. The foregoing memory includes various media that can store program codes, such as a U disk, a Read-Only Memory (ROM), a Random Access Memory (RAM), a removable hard disk, a magnetic disk or an optical disk.

Those of ordinary skill in the art can understand that all or part of the various methods in the foregoing embodiments can be accomplished by a program instructing the related hardware, and the program can be stored in a computer readable memory, and the memory can include: a flash disk, a read-only memory, a random accessor, a disk or an optical disk.

The detail description has been introduced above for the embodiment of the invention. Herein, a specific case is applied in this article for explain the principles and specific embodiments of the present invention have been set forth. The description of the aforesaid embodiments is only used to help understand the method of the present invention and the core idea thereof; meanwhile, for those of ordinary skill in the art, according to the idea of the present invention, there should be changes either in the specific embodiments and applications but in sum, the contents of the specification should not be limitation to the present invention.

What is claimed is:

1. A multi zone backlight controlling method, comprising:

obtaining original grayscale values of pixels of an image displayed in a display area, wherein the display area includes a first partition and a second partition, the image includes a first image block and a second image block, the first image block is displayed in the first partition, and the second image block is displayed in the second partition, the original grayscale value includes a first original grayscale value of each pixel point in the first image block and a second original grayscale value of each pixel point in the second image block;

obtaining a backlight control coefficient correction factor of the image according to the original grayscale value;

obtaining a first backlight control coefficient of the first partition based on the backlight control coefficient correction factor and the first original grayscale value, and adjusting a backlight brightness of the first partition according to the first backlight control coefficient; and obtaining a second backlight control coefficient of the second partition based on the backlight control coefficient correction factor and the second original grayscale value, and adjusting a backlight brightness of the second partition according to the second backlight control coefficient;

wherein the step of obtaining the backlight control coefficient correction factor of the image according to the original grayscale value comprises:

performing an average operation on the first original grayscale values to obtain a first reference grayscale value of the first image block, and performing an average operation on the second original grayscale values to obtain a second reference grayscale value of the second image block, and performing an average operation on the first reference grayscale value and the second reference grayscale value to obtain a target reference grayscale value of the image, and obtaining the backlight control coefficient correction factor based on the target reference grayscale value;

or, performing an average operation on the original grayscale values of pixels of the image to obtain the target reference grayscale value of the image, and obtaining the backlight control coefficient correction factor based on the target reference grayscale value;

wherein the step of obtaining the backlight control coefficient correction factor based on the target reference grayscale value comprises:

a function mapping relationship between the target reference grayscale value and the backlight control coefficient correction factor:

$$f(x)=\begin{cases} 0,\ x=0 \\ 1,\ x\in[0.05a,\ 0.3a] \\ (0.5,\ 1),\ x=a \\ (0,\ 0.5],\ x\in(0,\ 0.05a)\cup(0.3a,\ a) \end{cases},$$

wherein f(x) is the backlight control coefficient correction factor, and x is the target reference grayscale value, and a is a maximum grayscale value of the pixel point of the image in the display area;

the backlight control coefficient correction factor is obtained after the target reference grayscale value is transformed by the function mapping relationship.

2. The method according to claim 1, wherein the step of obtaining the first backlight control coefficient of the first partition based on the backlight control coefficient correction factor and the first original grayscale value comprises:

comparing the first original grayscale value with a preset grayscale threshold to obtain a target grayscale value greater than the preset grayscale threshold in the first original grayscale value;

obtaining a weighted average value of the target grayscale values, and obtaining a first reference backlight control coefficient of the first image block according to the weighted average value; and obtaining the first backlight control coefficient based on the first reference backlight control coefficient and the backlight control coefficient correction factor.

3. The method according to claim 1, wherein the step of obtaining the first backlight control coefficient of the first partition based on the backlight control coefficient correction factor and the first original grayscale value comprises:

comparing the first original grayscale value with a preset grayscale threshold to obtain a target grayscale value greater than the preset grayscale threshold in the first original grayscale value;

determining whether a number of the target grayscale values is greater than a preset number, and as the number of the target grayscale values is greater than the preset number, the target grayscale value is the first reference backlight control coefficient of the first image block; and obtaining the first backlight control coefficient based on the first reference backlight control coefficient and the backlight control coefficient correction factor.

4. A multi zone backlight controlling device, comprising:

an obtaining unit, obtaining original grayscale values of pixels of an image displayed in a display area, wherein the display area includes a first partition and a second partition, the image includes a first image block and a second image block, the first image block is displayed in the first partition, and the second image block is displayed in the second partition, the original grayscale value includes a first original grayscale value of each pixel point in the first image block and a second original grayscale value of each pixel point in the second image block;

a calculating unit, obtaining a backlight control coefficient correction factor of the image according to the original grayscale value;

a first processing unit, obtaining a first backlight control coefficient of the first partition based on the backlight control coefficient correction factor and the first original grayscale value, and adjusting a backlight brightness of the first partition according to the first backlight control coefficient; and a second processing unit, obtaining a second backlight control coefficient of the second partition based on the backlight control coefficient correction factor and the second original grayscale value, and adjusting a backlight brightness of the second partition according to the second backlight control coefficient;

wherein the calculating unit comprises:

a first calculating module, performing an average operation on the first original grayscale values to obtain a first reference grayscale value of the first image block, and performing an average operation on the second original grayscale values to obtain a second reference grayscale value of the second image block, and performing an average operation on the first reference grayscale value and the second reference grayscale value to obtain a target reference grayscale value of the image, and obtaining the backlight control coefficient correction factor based on the target reference grayscale value;

a second calculating module, performing an average operation on the original grayscale values of pixels of the image to obtain the target reference grayscale value of the image, and obtaining the backlight control coefficient correction factor based on the target reference grayscale value;

wherein the first calculating module comprises:

a function mapping relationship between the target reference grayscale value and the backlight control coefficient correction factor:

$$f(x) = \begin{cases} 0, x = 0 \\ 1, x \in [0.05a, 0.3a] \\ (0.5, 1), x = a \\ (0, 0.5], x \in (0, 0.05a) \cup (0.3a, a) \end{cases},$$

wherein f(x) is the backlight control coefficient correction factor, and x is the target reference grayscale value, and a is a maximum grayscale value of the pixel point of the image in the display area;

a calculating sub module, obtaining the backlight control coefficient correction factor after transforming the target reference grayscale value with the function mapping relationship.

5. The device according to claim 4, wherein the first processing unit comprises:

a first processing module, comparing the first original grayscale value with a preset grayscale threshold to obtain a target grayscale value greater than the preset grayscale threshold in the first original grayscale value;

a third calculating module, obtaining a weighted average value of the target grayscale values, and obtaining a first reference backlight control coefficient of the first image block according to the weighted average value; and a second processing module, obtaining the first backlight control coefficient based on the first reference backlight control coefficient and the backlight control coefficient correction factor.

6. The device according to claim 4, wherein the first processing unit comprises:

a third processing module, comparing the first original grayscale value with a preset grayscale threshold to obtain a target grayscale value greater than the preset grayscale threshold in the first original grayscale value;

a fourth calculating module, determining whether a number of the target grayscale values is greater than a preset number, and as the number of the target grayscale values is greater than the preset number, the target grayscale value is the first reference backlight control coefficient of the first image block; and a fourth processing module, obtaining the first backlight control coefficient based on the first reference backlight control coefficient and the backlight control coefficient correction factor.

* * * * *